US006094868A

United States Patent [19]

Otaka et al.

[11] Patent Number: 6,094,868

[45] Date of Patent: Aug. 1, 2000

[54] HANDLE UNIT OF A MANUAL WINDOW APPARATUS

[75] Inventors: Hiroshi Otaka; Shoichiro Yokoi, both of Shizuoka, Japan

[73] Assignee: Koito Manufacturing Co., Ltd., Tokyo, Japan

[21] Appl. No.: 09/257,210

[22] Filed: Feb. 25, 1999

[30] Foreign Application Priority Data

Mar. 23, 1998 [JP] Japan ..... 10-073641

[51] Int. Cl.[7] ..... E05F 15/08

[52] U.S. Cl. ..... 49/349; 74/89.2

[58] Field of Search ..... 49/348, 349, 350, 49/351, 352, 353, 139, 140; 74/89.2, 89.22

[56] References Cited

U.S. PATENT DOCUMENTS

| | | | |
|---|---|---|---|
| 4,306,378 | 12/1981 | Fukura et al. | 49/352 |
| 4,577,439 | 3/1986 | Seki | 49/352 |
| 4,753,125 | 6/1988 | Fukumoto et al. | 49/352 X |
| 4,813,304 | 3/1989 | Kobayashi | 49/352 X |
| 4,840,080 | 6/1989 | Kobayashi et al. | 49/352 X |
| 4,878,391 | 11/1989 | Komatsu et al. | 74/89.2 |
| 5,074,077 | 12/1991 | Toyoshima et al. | 49/352 |
| 5,199,310 | 4/1993 | Yoshimura | 74/89.2 |
| 5,279,468 | 1/1994 | Küster | 49/352 X |
| 5,564,231 | 10/1996 | Tajima et al. | 49/352 |

*Primary Examiner*—Jerry Redman
*Attorney, Agent, or Firm*—Sughrue, Mion, Zinn, Macpeak & Seas, PLLC

[57] ABSTRACT

A handle unit of a manual window apparatus including a base plate 110 that has a brake drum part 111, a handle shaft 120 that penetrates the base plate 110, a brake spring 140 that is mounted inside the brake drum part 111, a spring hanger 160 that is fitted on the handle shaft 120 and that is joined with the handle shaft 120 in a circumferential direction via the brake spring 140, a volute balance spring 170 that is laid over a surface of the base plate 110 in an outer circumferential area of the spring hanger 160 and that is mounted between the spring hanger 160 and the base plate 110, a wire drum 180 that is fitted on the handle shaft 120 so as to form a single body with the spring hanger 160 in a circumferential direction and that is wound around on the circumferential surface thereof with a wire for opening-closing actions of a window glass, and a cover that has a container part 191 that covers the wire drum and that is secured to the base plate 110.

16 Claims, 5 Drawing Sheets

HANDLE UNIT OF A MANUAL WINDOW APPARATUS

BACKGROUND OF THE INVENTION

1. Field of the Invention

The present invention is applicable to vehicles, such as automobiles, and relates to a manual window apparatus for opening and closing a window through manual operation of a handle, and more specifically to a manual window apparatus having a simplified assembling process.

2. Background Art

Various types of manual window apparatuses for manually opening and closing windows of a motor vehicle have been proposed, and a wire-type window apparatus has been proposed with merits in size reduction of the window apparatus and also in space reduction.

FIG. 4 shows a simplified structure of a conventional window apparatus 10, wherein, directly under a window glass 11 for opening and closing an opening of a motor vehicle, a rail 12 is securely supported on a motor vehicle body in an opening-closing direction of the window glass 11, and a slider 13 is mounted on the rail 12 so as to allow sliding in longitudinal directions with the window glass 11 being supported by the rail 12. At upper and lower ends of the rail 12, pulleys 14 are securely fixed, and an intermediate part of a wire 15 which is wound around the pulleys is extended along the rail 12 and joined with the slider 13 at a portion thereof. Both end parts of the wire 15 are inserted through guide tubes 16 and joined with a handle unit 17. The handle unit 17 is provided with a handle (not shown in the figure) to be rotated manually by a passenger. The window glass 11 moves up and down when the slider 13 is transferred along the rail by the wire 15 when the handle is rotated.

FIG. 5 shows a perspective assembly view of a conventional handle unit as an example of the above-described handle unit 17. The conventional handle unit 200 is provided with a handle shaft 220 to be axially revolved by a rotational operation of a handle, a wire drum 280 for transfer of the wire 15 when the handle shaft 220 is revolved axially, a balance spring 270 for reducing a difference in the operating forces at times of lifting (closing) and lowering (opening) the window glass 11 (the difference being due to the weight of the window glass) through accumulation of rotational force at the handle while the window glass 11 is being lowered and application of the accumulated force as an assisting force while the window glass is being lifted, a spring hanger 260 for connecting an end part of the balance spring 270 to the handle shaft 220, and a brake spring 240 for retaining the window glass 11 at an opening or closing position at that moment when the handle rotation is stopped. The handle shaft 220 has a spring sheet 250 attached thereto to engage the brake spring 240 with the handle shaft 220. The handle shaft 220, the spring sheet 250, the wire drum 280, the balance spring 270, the spring hanger 260 and the brake spring 240, which are mounted inside a casing that is composed of a base 210 and a cover 290, constitute a unit component.

When this handle unit 200 is assembled, first, the balance spring 270 is placed inside a cylindrical cavity 211 which is formed in the base 210 and an inner circumferential end is locked by a part of the base 210. Next, the spring hanger 260 is mounted on the balance spring 270, and the outer circumferential end of the balance spring 270 is locked by the spring hanger 260. The wire drum 280 is mounted on the spring hanger 260 so as to be unified with the spring hanger 260 in a circumferential direction, and then the brake spring 240 is mounted on the wire drum 280/spring hanger 260. Next, the handle shaft 220 is inserted into the wire drum 280 and a shaft hole formed in the spring hanger 260 and simultaneously both end parts of the brake spring 240 are locked between the spring hanger 260 and the spring sheet 250 which is provided as part of the handle shaft 220 in the shape of a circle with a cut-out portion. Finally, a cover 290 which has a frame drum part 291 formed as a round depression as an integral part thereof for covering the outer circumference of the brake spring 240 is placed over and then secured to the base 210 with screws or other fasteners (not shown in the figure).

The conventional handle unit 200, in which the balance spring 270 is internally mounted after it has been placed inside the cylindrical cavity 211 in the base 210 and in which, with the spring hanger 260 placed thereon, the outer circumferential end part of the balance spring 270 is locked by the spring hanger 260, requires experience and a long time to assemble due to the fact that the assembling operator must work blindly without visually checking the locking of the outer circumferential end part and the spring hanger 260, since the outer circumferential end part is positioned under the spring hanger 260. Moreover, the process of winding a wire 15 around the assembled wire drum 280, while preventing the wire drum 280 and the spring hanger 260 from being removed from the balance spring 270 by keeping pressure on them during the winding operation, decreases the efficiency of the wire winding operation.

The conventional handle unit has another problem. Specifically, as shown in FIG. 3(*b*), the handle unit 200 is secured to the inner panel 18 with the side for attachment of a handle facing the inside of the vehicle. As described above, when the cover 290 on the side for attachment of the handle is secured to the inner panel 18 with brackets 292 and bolts 293, the wire 15 is positioned in close proximity to the inner panel 18 since the wire drum 280 is positioned on the cover 290 side, and thus there is a fear that the wire 15 in the proximity of area X may interfere with the inner panel 18 to prevent smooth opening-closing operations. In this case, if an attempt is made to position the wire 15 far from the inner panel 18, the dimension D2 in the figure becomes large and, consequently, the consistency of the clearance of the window glass cannot be maintained resulting in difficulty in layout of the window apparatus.

The present invention is intended to provide a manual window apparatus wherein efficiency in the handle unit assembling work is improved and also wherein consistency in window glass layout for attachment to the motor vehicles can be realized.

SUMMARY OF THE INVENTION

The manual window apparatus of the present invention comprises a handle unit which has a base plate that has a brake drum part formed by a cylindrical cavity, a handle shaft that penetrates the brake drum part, a brake spring that is mounted inside the brake drum part, a spring hanger that is fitted on the handle shaft and that is joined with the handle shaft in a circumferential direction via the brake spring, a volute balance spring that is laid along a surface of the base plate in an outer circumferential area of the spring hanger and that is mounted between the spring hanger and the base plate, a wire drum that is fitted on the handle shaft so as to form a single body with the spring hanger in a circumferential direction and that is wound around on the circumferential surface thereof with a wire for opening-closing actions of a window glass, and a cover that has a cylindrical container part that covers the wire drum, the cover being secured to the base plate with the balance spring disposed in a space between the cover and the base plate. A handle for manual rotational operation is attached to the handle shaft on a base plate side of the handle shaft.

Since the handle unit is assembled in a process in which the wire drum is mounted after the handle shaft is connected with the spring hanger and the balance spring, the operation of mounting both ends of the balance spring between the spring hanger and the base plate can be performed while being visually observed, and the assembling operation can be simplified.

BRIEF DESCRIPTION OF THE DRAWING FIGURES

Figure 3B:
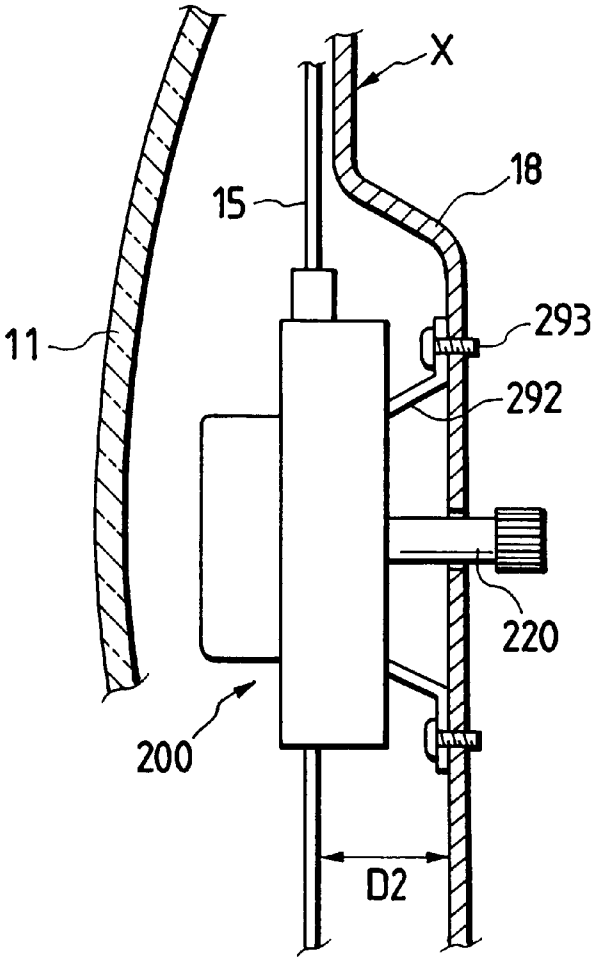
Figure 3A:
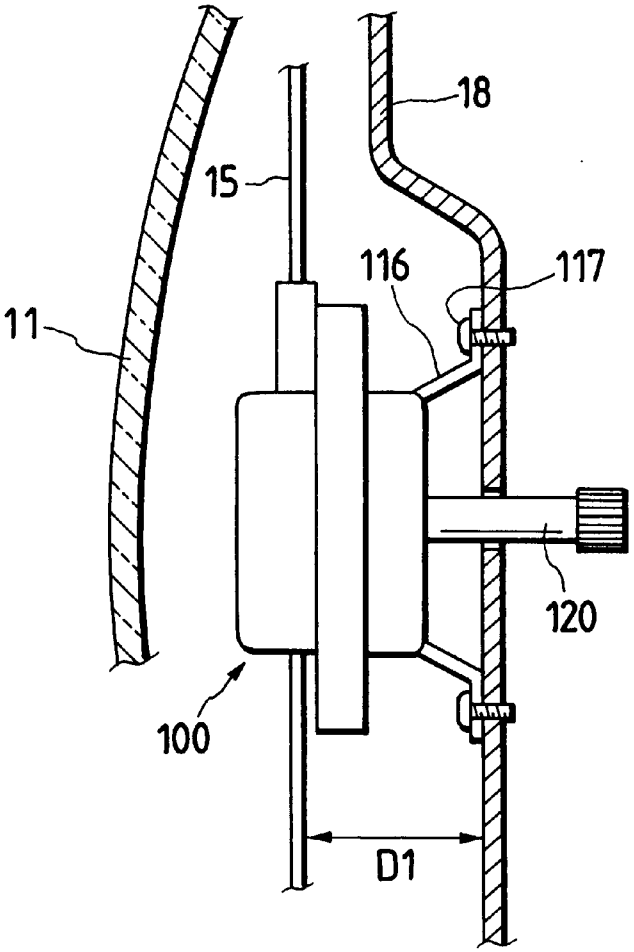
Figure 4:
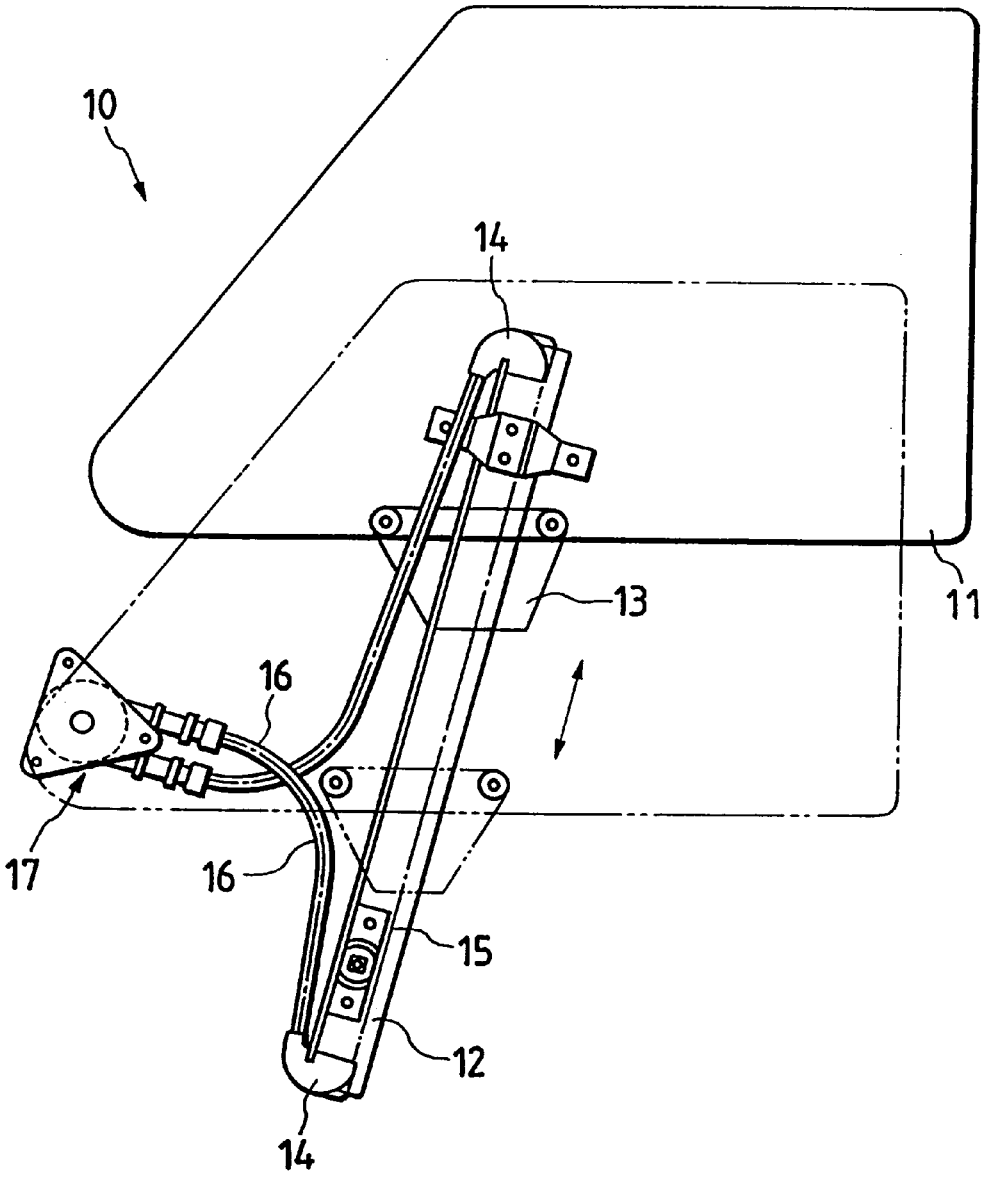
PRIOR ART FIG. 4
Figure 5:
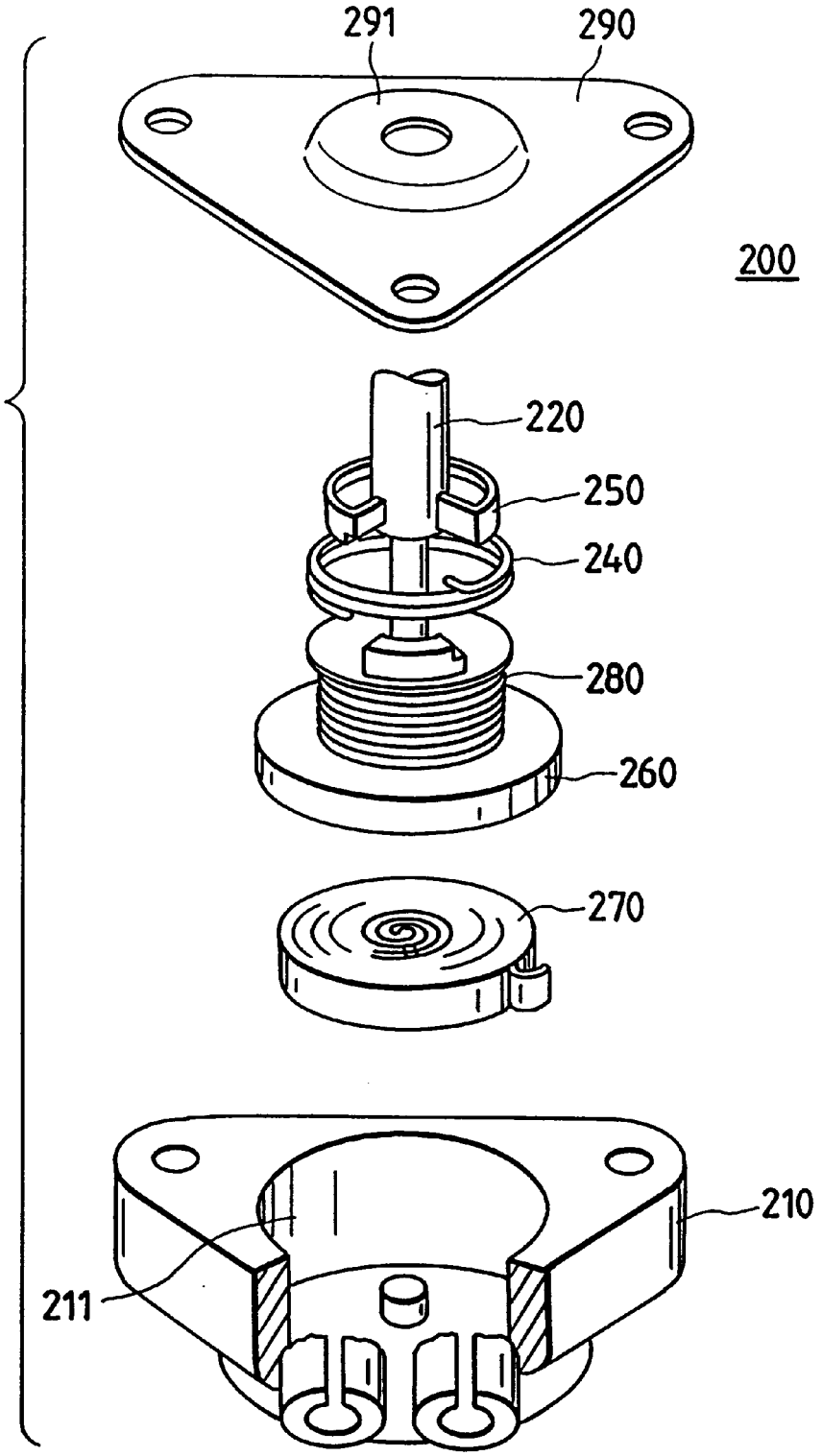
PRIOR ART FIG. 5

FIGS. 3(*a*) and 3(*b*) are partial sectional drawings showing the handle unit of the present invention and a conventional hand unit, respectively, which are attached inside the vehicle body;

FIG. 4 shows the entire structure of a conventional window apparatus to which the handle unit of the present invention is applied; and FIG. 5 is a partial perspective assembly drawing of a conventional handle unit with a partial sectional view.

DETAILED DESCRIPTION OF THE PREFERRED EMBODIMENTS

Figure 1:
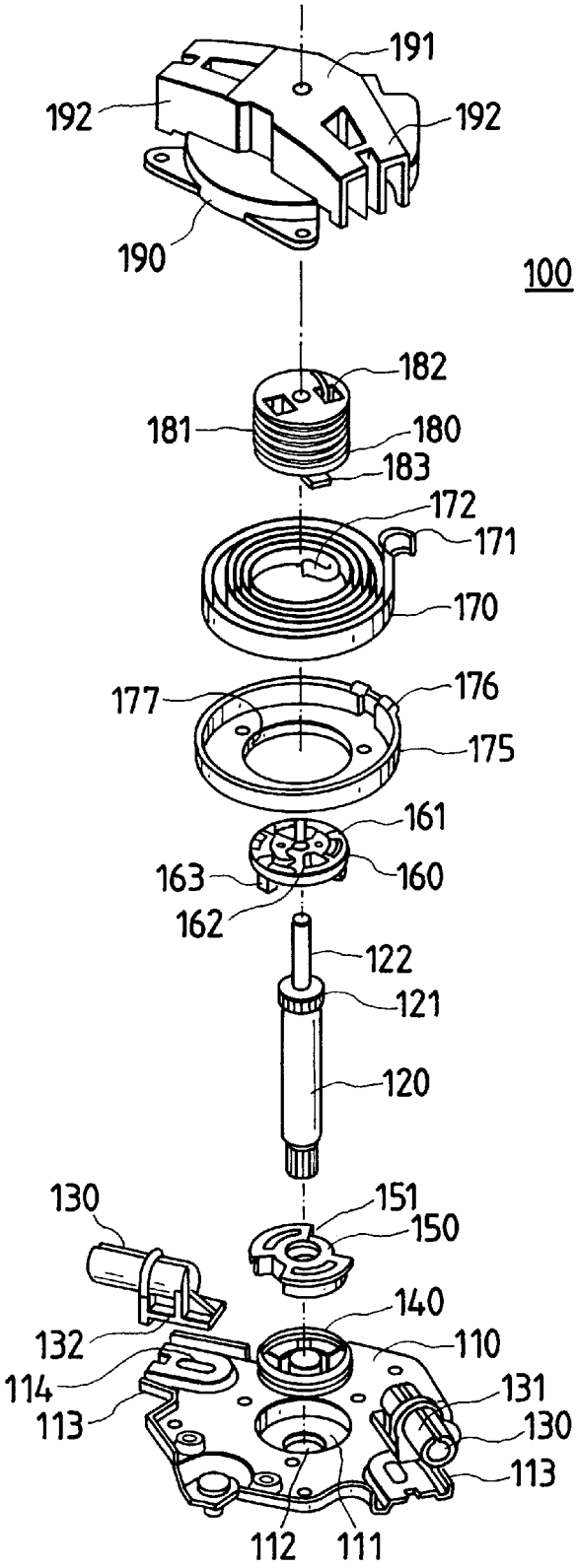
FIG. 1 is a partial perspective assembly drawing of an embodiment of a handle unit related to the present invention.
Figure 2:
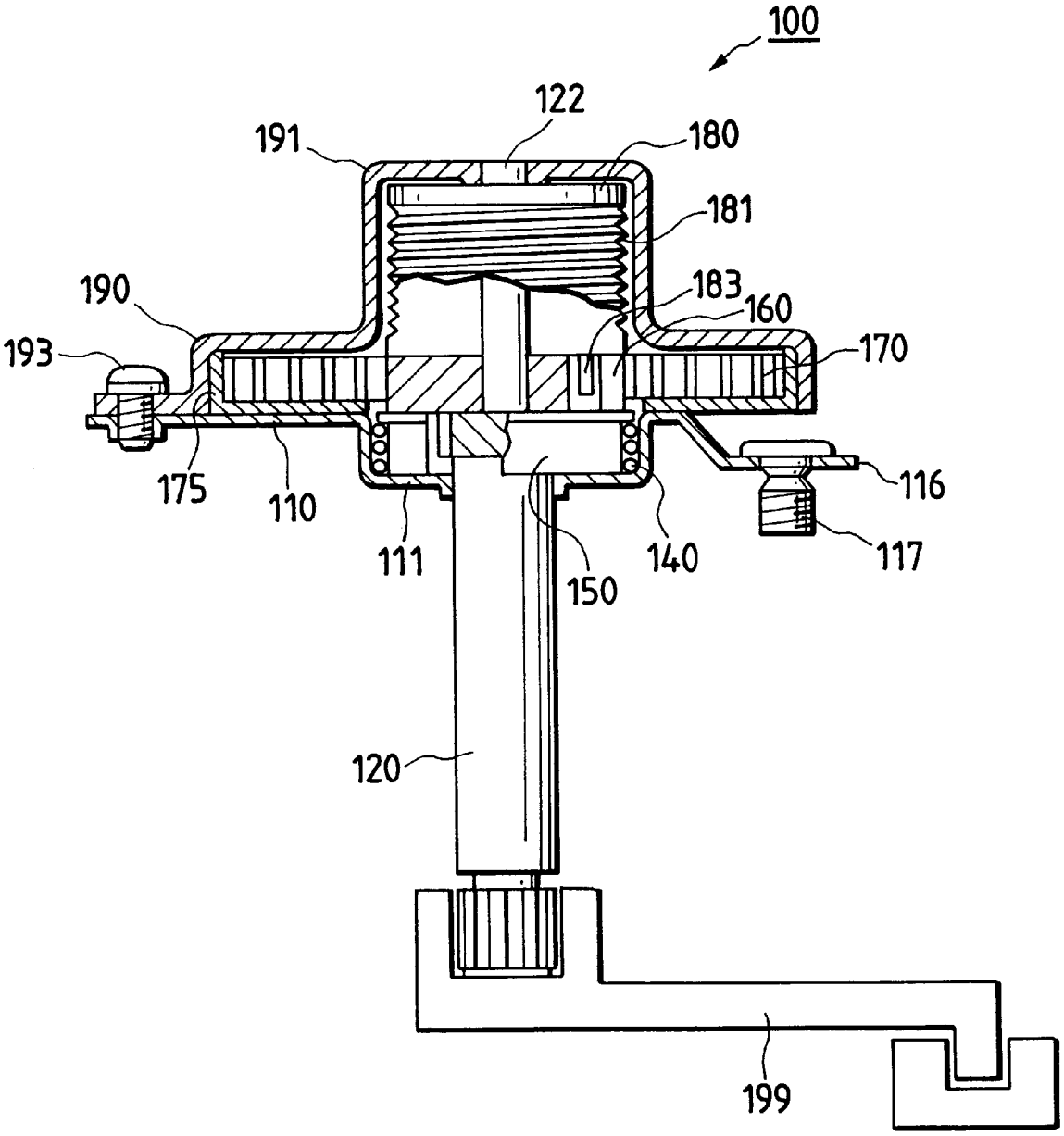
FIG. 2 is a cross sectional drawing of the handle unit shown in FIG. 1 in the assembled state.

With reference to the drawings, embodiments of the present invention are described below. FIG. 1 is a partial perspective assembly drawing of a handle unit 100 of the manual window apparatus related to the present invention, and FIG. 2 is a cross sectional drawing thereof in the assembled state.

A brake drum part 111 which consists of a shallow cylindrical cavity is formed in a base plate 110 and a shaft hole 112 for insertion of a handle shaft 120 is formed in the center of the brake drum part 111. Socket attachment bases 113 are formed at two opposite side positions across the brake drum part 111 in directions approximately tangent to the brake drum part 111, and wire sockets 130 respectively with a slit 131 in the circumference thereof fit in the socket attachment bases 113. An engagement hole 114 is formed in the socket attachment base 113 while a tongue piece is 132 formed as a part of the wire socket 130 so as to protrude toward the base end side. When the tongue piece 132 is attached to socket attachment base 113, a projection that is provided on the tongue piece 132 (not shown in the figure) engages the engagement hole 114 and the wire socket 130 is attached to the base plate 110 so as to form a single body. A guide member for guiding the wire 15 shown in FIG. 4 is fitted in each of the wire sockets 130.

A brake spring 140 which is a spring wire in the shape of a ring is mounted inside the brake drum part 111. The handle shaft 120 is inserted into the shaft hole from the front end side and a spring sheet 150, which is attached to the rear end of the handle shaft 120 in the rotational direction as an integral part via serrations 121, is mounted inside the brake drum 111. The spring sheet 150 is provided with two cut-outs 151 on the circumference at opposite positions in radial directions of the disc, and is in the shape of a bow-tie. A spring hanger 160 is inserted into a smaller-diameter part 122 which protrudes from behind the rear end part of the handle shaft 120 SO as to be free for rotation. The spring hanger 160 is formed in the shape of a disc with a cut-out on the circumference and also with an engagement through hole 162 in the plate thickness direction at another circumferential position. A locking projection 163 of a necessary circumferential angle is formed so as to protrude from the lower surface of the spring hanger 160. The locking projection 163 is positioned inside one of the cut-outs 151 of the spring sheet 150 and both end parts of the brake spring 140 are mounted between the locking projection 163 and the one cut-out 151 of the spring sheet 150. In a normal state, the brake spring 140 which expands in radial directions contacts the inner surface of the brake drum 111 with pressure and functions as a brake against the spring hanger 160 with a pressure contact force to lock the rotations thereof.

A balance spring 170 has a volute shape and is formed by a narrow-width band spring material with a plurality of turns. The balance spring 170 is placed on the surface of the base plate 110 in the outer circumferential area of the spring hanger 160. The balance spring 170 is mounted inside a spring case 175 of a shallow round plate made of resin, and the spring case 175 is mounted on the surface of the base plate 110 in a state such that its revolution is blocked. An outer circumferential end part 171 of the balance spring 170 is locked by insertion into a groove 176 which is provided at a part of the circumference of the spring case 175. An inner circumferential end part 172 which penetrates through a center hole 177 of the spring case 175 is locked by the cut-out 161 which is provided at a part of the circumference of the spring hanger 160. A wire drum 180 is penetrated by a small-diameter part 122 of the handle shaft 120 so as to revolve freely on the upper side of the spring hanger 160. A spiral groove is formed on the wire drum 180 along the axial direction of the circumferential surface thereof and the wire 15 is wound around in the spiral groove 181. The end parts of the wire 15 are guided by locking grooves 182 which are provided on top and bottom surfaces of the wire drum 180 and then locked respectively.

On the lower surface of the wire drum 180, projections 183 are formed to extend in the axial direction at two radially confronting positions on the circumference. The projections 183 respectively fit in the engagement holes 162 in the spring hanger 160 and thus the wire drum 180 is unified with the spring hanger 160 in the circumferential direction. A cover 190 includes a container part 191 that is of a slightly larger diameter than the outer diameter of the wire drum 180 for covering the spring hanger 160, the balance spring 170 and the wire drum 180, and a cover part 192 for covering the pair of wire sockets. The container part 191 and the cover part 192 are formed into a single piece which is placed on and secured to the base plate 110 with screws 193.

Since the actions performed by the handle unit of the present invention are the same as those of the conventional handle units, only a simple explanation is given here. Specifically, when a handle 199 (see FIG. 2) which is connected to the front end part of the handle shaft 120 is rotated, the handle shaft 120 is revolved and the revolving force is transmitted to the spring sheet 150 which is unified with the handle shaft 120. When the handle is rotated in the direction to lower the window glass, the rotational force transmitted to the spring sheet 150 generates a relative force in the rotational direction between the spring sheet 150 and the spring hanger 160, which reduces the diameter of the brake spring 140 and thus the braking state caused by the pressure contact state with the inner surface of the brake drum part 111 is released. Therefore, the rotational force of the spring sheet 150 is transmitted to the spring hanger 160 and then to the wire drum 180. At this time, the spring hanger 160 deforms the balance spring 170 in a direction of energy accumulation, i.e., in the direction of reducing the volute diameter. Simultaneously, the wire 15 that is wound around the wire drum 180 is transferred to lower the slider 13 along the rail 12 and the window glass 11 is lowered. Next, when the rotational operation of the handle is stopped, the relative force between the spring sheet 150 and the spring hanger 160 is reduced to return the brake spring to the normal state where the brake is working, and the window glass 11 is stopped at this position.

By way of contrast, when the handle is rotated in the direction to lift the window glass, the rotational force transmitted to the spring sheet 150 releases the brake effected by the brake spring 140 in the same way as at the time of lowering, and the rotational force of the spring sheet 150 is transmitted to the spring hanger 160 and further to the wire drum 180. This transfers the wire 15 that is wound around the wire drum 180 to lift the slider 13 along the rail 12 and the window glass 11 is lifted. Since the spring hanger 160 is turned in a direction to release the energy from the balance spring 170, that is in the direction to enlarge the volute diameter at this time, the rotation is facilitated by elastic restoring force of the balance spring 170. Therefore, the rotational operating force at the handle is reduced by the force of the balance spring 170, and thus the possible increase in the operating force due to the weight of the window glass when the window glass 11 is lifted is cancelled and the handle rotating forces at lifting and lowering of the window glass 11 are balanced. Also, when the rotational operation of the handle is stopped, the brake spring recovers its normal state and the window glass 11 is stopped at this position by the braking effect.

As described above, when the handle unit according to this embodiment is assembled, the brake spring 140 is mounted inside the brake drum part 111 of the base plate 110 in a first process while the handle shaft 120 where the spring sheet 150 is unified into a single piece is inserted through the shaft hole 112 and then, after the smaller-diameter part 122 of the handle shaft 120 is inserted into the spring hanger 160, both end parts of the brake spring 140 are inserted in the circumferential direction between the spring sheet 150 and the spring hanger 160, which is performed with ease since the operation can be visually observed.

Next, in a second process, the balance spring 170 is mounted inside the spring case 175 and the spring case 175 is placed on the base plate 11 while the spring hanger 160 is placed inside the center hole 177 of the spring case 175. Then, the outer circumferential end 171 and inner circumferential end 172 of the balance spring 170 are respectively locked in the groove 176 of the spring case 175 and the cut-out 161 in the spring hanger 160, which operation is visually observed and carried out with ease. Additionally, since the spring case 175 prevents the balance spring 170 from radial expansion by its elastic force, the mounting operation is further facilitated. Furthermore, the spring case 175 made of resin prevents the balance spring 170 made of metal and the base plate 110 made of metal from directly contacting to generate metallic sounds.

In a third process, the wire drum 180 where wire is wound around in the spiral groove is inserted over the small-diameter part 122 of the handle shaft 120 in advance and both side parts of the wire are inserted into the wire sockets 130 through the slits 131, which operation is carried out with extreme ease since the wire does not need to be wound in the spiral groove 181 after the wire drum 180 is mounted. Finally, in a fourth process, the cover 190 is placed on and secured to the base plate 10 with screws 193 to complete the handle unit 100. Therefore, if compared with conventional handle units, the assembly operations are simplified and the assembly work is carried out with ease.

Moreover, since the balance spring 170 of the handle unit 100 of the present invention is mounted inside the spring case that is disposed on the surface of the base plate 110, the cover 190 is large enough provided that the container part 191 and the cover part 192 have a diameter and a height that can house the wire drum 180. Consequently, there is no need for a cylindrical cavity having a large diameter for housing the balance spring as in the above-described conventional structure, and thus a size reduction of the handle unit can be realized.

Additionally, in the handle unit of this embodiment, the wire drum 180 is disposed at a position on the side of the cover 190 which is furthest from the base plate 110, and thus, when the handle unit 100 is attached inside a door of a motor vehicle, for example, in such a manner as shown in FIG. 3(*a*) where the front end side of the handle shaft 120 protrudes into the cabin of the motor vehicle, bracket parts 116 which are provided on the base plate 110 are secured to the inner panel 18 with bolts 117. Consequently, since the wire 15 is extended at a position distant from the inner panel 18, the wire 15 is mostly prevented from interference with the inner panel 18 and the dimension D1 in the figure can be reduced, resulting in consistency in the layout of the window glass 11.

Although, in the above-described embodiment, the spring sheet 150 is formed as a piece separate from the handle shaft 120, these two parts may be formed as a single piece so long as the processing procedures can be simplified. In another feasible structure, the wire drum 180 and the spring hanger 160 may be formed as a single piece or semi-integrally.

As described above, the handle unit according to the present invention has a structure in which the brake spring is disposed on the base plate side, and in which the balance spring which is mounted between the spring hanger and the base plate is disposed on the upper side thereof with the wire drum disposed thereon. The handle unit is assembled by a procedure in which the handle shaft is inserted into the base plate and, after the spring hanger and the balance spring are mounted on the handle shaft, the wire drum which the wire is wound around is mounted. The operation of mounting both ends of the balance spring between the spring hanger and the base plate can be carried out while being observed visually, and therefore the assembly operations are simplified. Since the handle for manual rotational operation is attached to the handle shaft that penetrates the base plate which is secured to the motor vehicle body panel, the wire which is wound around the wire drum that is positioned to be distant from the base plate can be extended at a position distant from the motor vehicle body panel, and thus the attachment space can be reduced while the interference of the wire and the vehicle body panel can be prevented and the consistency of the window glass layout can be achieved.

We claim:

1. A handle unit of a manual window apparatus, comprising a base plate (110) having a brake drum part (111) followed by a cylindrical cavity;

a handle shaft (120) penetrating said brake drum part;

a brake spring (140) mounted inside said brake drum part;

a spring hanger (160) initially fitted on said handle shaft so as to be freely rotatable about said handle shaft, and subsequently joined with said handle shaft in a circumferential direction via said brake spring;

a volute balance spring (170) placed over a surface of said base plate in an outer circumferential area of said spring hanger and mounted between said spring hanger and said base plate;

a wire drum (180) fitted on said handle shaft and joined with said spring hanger in the circumferential direction; and a container part (191) that covers said wire drum, and a cover (190) in which said balance spring is disposed and which is secured to said base plate.

2. The handle unit claimed in claim 1, further comprising a handle (199) attached to said handle shaft on a base plate side of said handle shaft.

3. The handle unit claimed in claim 1, further comprising a spring case (175) disposed between said balance spring and said base plate, said balance spring being disposed inside said spring case.

4. The handle unit claimed in claim 3, wherein said spring case is fixedly secured to said base plate, and one end of said balance spring is secured to said spring case, and the other end of said balance spring is fixedly secured to said spring hanger.

5. The handle unit claimed in claim 1, further comprising a spring sheet (150) fixedly secured to said handle shaft.

6. The handle unit claimed in claim 5, wherein said spring sheet has a cut-out (151) and wherein said spring hanger has a projection (163), said brake spring being mounted between said cut-out and said projection.

7. The handle unit claimed in claim 1, wherein said wire drum has projections (183) which fit into engagement holes (162) in said spring hanger.

8. The handle unit claimed in claim 1, further comprising a handle attached to said handle shaft, and wherein said balance spring is disposed along said handle shaft at a position closer to said handle than a position where said wire drum is disposed along said handle shaft.

9. The handle unit claimed in claim 1, wherein said spring hanger is disposed inside said balance spring in a radial direction of said handle shaft.

10. A handle unit of a manual window apparatus, comprising:

a base plate (110) having a brake drum part (111) formed by a cylindrical cavity;

a handle shaft (120) penetrating said brake drum part;

a brake spring (140) mounted inside said brake drum part;

a spring hanger (160) fitted on said handle shaft and joined with said handle shaft in a circumferential direction via said brake spring;

a volute balance spring (170) placed over a surface of said base plate in an outer circumferential area of said spring hanger and mounted between said spring hanger and said base plate;

a wire drum (180) fitted on said handle shaft and joined with said spring hanger in the circumferential direction;

a container part (191) that covers said wire drum, and a cover (190) in which said balance spring is disposed and which is secured to said base plate; and a spring sheet (150) fixedly secured to said handle shaft.

11. The handle unit claimed in claim 10, wherein said spring sheet has a cut-out (151) and wherein said spring hanger has a projection (163), said brake spring being mounted between said cut-out and said projection.

12. The handle unit claimed in claim 10, further comprising a handle attached to said handle shaft, and wherein said balance spring is disposed along said handle shaft at a position closer to said handle than a position where said wire drum is disposed along said handle shaft.

13. The handle unit claimed in claim 10, wherein said spring hanger is disposed inside said balance spring in a radial direction of said handle shaft.

14. A handle unit of a manual window apparatus, comprising:

a base plate (110) having a brake drum part (111) formed by a cylindrical cavity;

a handle shaft (120) penetrating said brake drum part;

a brake spring (140) mounted inside said brake drum part;

a spring hanger (160) fitted on said handle shaft and joined with said handle shaft in a circumferential direction via said brake spring;

a volute balance spring (170) placed over a surface of said base plate in an outer circumferential area of said spring hanger and mounted between said spring hanger and said base plate;

a wire drum (180) fitted on said handle shaft and joined with said spring hanger in the circumferential direction;

a container part (191) that covers said wire drum, and a cover (190) in which said balance spring is disposed and which is secured to said base plate; and a spring case (175) disposed between said balance spring and said base plate, said balance spring being disposed inside said spring case;

wherein said spring case is fixedly secured to said base plate, and one end of said balance spring is secured to said case, and the other end of said balance spring is fixedly secured to said spring hanger.

15. The handle unit claimed in claim 14, further comprising a handle attached to said handle shaft, and wherein said balance spring is disposed along said handle shaft at a position closer to said handle than a position where said wire drum is disposed along said handle shaft.

16. The handle unit claimed in claim 14, wherein said spring hanger is disposed inside said balance spring in a radial direction of said handle shaft.

* * * * *